United States Patent [19]

Wagner

[11] Patent Number: 4,771,685

[45] Date of Patent: Sep. 20, 1988

[54] CAN COMPACTING APPARATUS WITH SELECTABLE EXIT PORTS AND METHOD THEREFOR

[75] Inventor: Cortlund M. Wagner, 2725 W. Cholla St., Apache Junction, Ariz. 85220

[73] Assignees: Dora Lee Wagner; Cortlund M. Wagner

[21] Appl. No.: 54,323

[22] Filed: May 26, 1987

[51] Int. Cl.[4] ..... B30B 9/32

[52] U.S. Cl. ..... 100/245; 100/53; 100/218; 100/902

[58] Field of Search ..... 100/902, 53, 245, 218

[56] References Cited

U.S. PATENT DOCUMENTS

| | | | |
|---|---|---|---|
| 2,982,200 | 5/1961 | Robertson et al. | 100/902 X |
| 4,216,713 | 8/1980 | Jung | 100/902 X |
| 4,235,164 | 11/1980 | Allen et al. | 100/245 |
| 4,240,341 | 12/1980 | Whipple et al. | 100/53 |
| 4,296,683 | 10/1981 | Lidik et al. | 100/902 X |
| 4,436,026 | 3/1984 | Imamura et al. | 100/902 X |
| 4,570,536 | 2/1986 | Dodd | 100/53 |

*Primary Examiner*—Andrew M. Falik

*Attorney, Agent, or Firm*—Harry M. Weiss & Associates

[57] ABSTRACT

An improved electrically powered can compacting apparatus including a piston-type plunger to longitudinally crush cans and then deposit them either in a container therebelow or onto the surface upon which the compactor is supported. The improved compacting apparatus incorporates an automatic feed safety hopper and is powered by a non-reversing electric motor which drives a series of low-friction reduction gear assemblies. The final reduction gear assembly, in turn, reciprocally drives the compacting piston.

3 Claims, 3 Drawing Sheets

CAN COMPACTING APPARATUS WITH SELECTABLE EXIT PORTS AND METHOD THEREFOR

BACKGROUND OF THE INVENTION

1. Field of the Invention

The present invention generally relates to an improved can compacting apparatus and, more specifically, to an electrically powered can compacting apparatus generally consisting of a plurality of gears operably coupled with a piston-type plunger to longitudinally crush cans and deposit them in a desired area.

2. Description of the Prior Art

In the past, the electrically powered systems developed for crushing or compacting cans were subject to major flaws. The systems of the past tend to be large and complicated or, on the other hand, limited to the hand feeding and then processing of one can at a time. Also, longitudinal crushing systems incorporated threaded shafts which require reversing motors and which create a relatively high level of friction in the drive train.

The prior art reveals numerous references. For example, McClure et al. (U.S. Pat. No. 3,960,070) disclose a compacting device with a door assembly which allows only one can to be loaded at a time and which includes a plunger with threaded movement which is triggered and limited by trip arms which activate switches to reverse the motor. The can crusher disclosed by Dodd (U.S. Pat. No. 4,570,536) requires the user to hand feed cans into the crusher one at a time and to manually remove the crushed can thereafter. Dodd also discloses a threaded shaft for moving a plunger and a switch for reversing the motor. A relatively large and heavy device for flattening cans, which does not include a plunger mechanism, is taught by Newman (U.S. Pat. 4,444,100). Bischoff (U.S. Pat. 3,817,169) discloses a can crusher which includes a complicated feeding device consisting of spaced rods and a pair of pins affixed to a finger supporting shaft. Whipple et al. (U.S. Pat. No. 4,240,341) describe a can crushing device which incorporates a threaded shaft to move a plunger and a reversible motor activated by a reversing switch. The Talley (U.S. Pat. No. 4,358,994) reference provides a hand fed can flattener which bends and then flattens the can and which requires a limit switch. Hiatt (U.S. Pat. No. 4,103,609) discloses a can pelletizer which, akin to Talley and others, must be hand fed and which includes both a plunger connected to a threaded shaft and a reversing motor with a limit switch connected thereto.

Accordingly, there is a distinct need for an apparatus for longitudinally crushing aluminum cans and the like, which may be automatically fed, which operates without requiring a reversing motor, which utilizes a low friction drive train, and which is adjustable to deposit compacted cans either in a variety of receptacles or on a flat surface upon which the apparatus is supported.

SUMMARY OF THE INVENTION

It is an object of this invention to provide an improved can compacting apparatus.

It is another object of this invention to provide a light weight yet durable can compacting apparatus which utilizes a low friction drive train.

It is a further object of this invention to provide an improved and portable can compacting apparatus, of relatively simple design, construction, and operation, which is fairly inexpensive to manufacture.

It is another object of this invention to provide an improved can compacting apparatus, which may easily be adjusted to be positioned over and supported by a variety of receptacles, or which may be employed on a flat supporting surface such as a table or counter.

It is a still further object of this invention to provide an improved can compacting apparatus for longitudinally crushing cans and which incorporates a reciprocating piston operably coupled to a non-reversing motor.

It is yet another object of this invention to provide an improved can compacting apparatus that is safe to use and that incorporates a means for automatically feeding a plurality of cans into the compactor.

The foregoing and other objects, features and advantages of this invention will be apparent from the following, more particular, description of the preferred embodiments of this invention, as illustrated in the accompanying drawings.

DESCRIPTION OF THE PREFERRED EMBODIMENT

Figure 1:
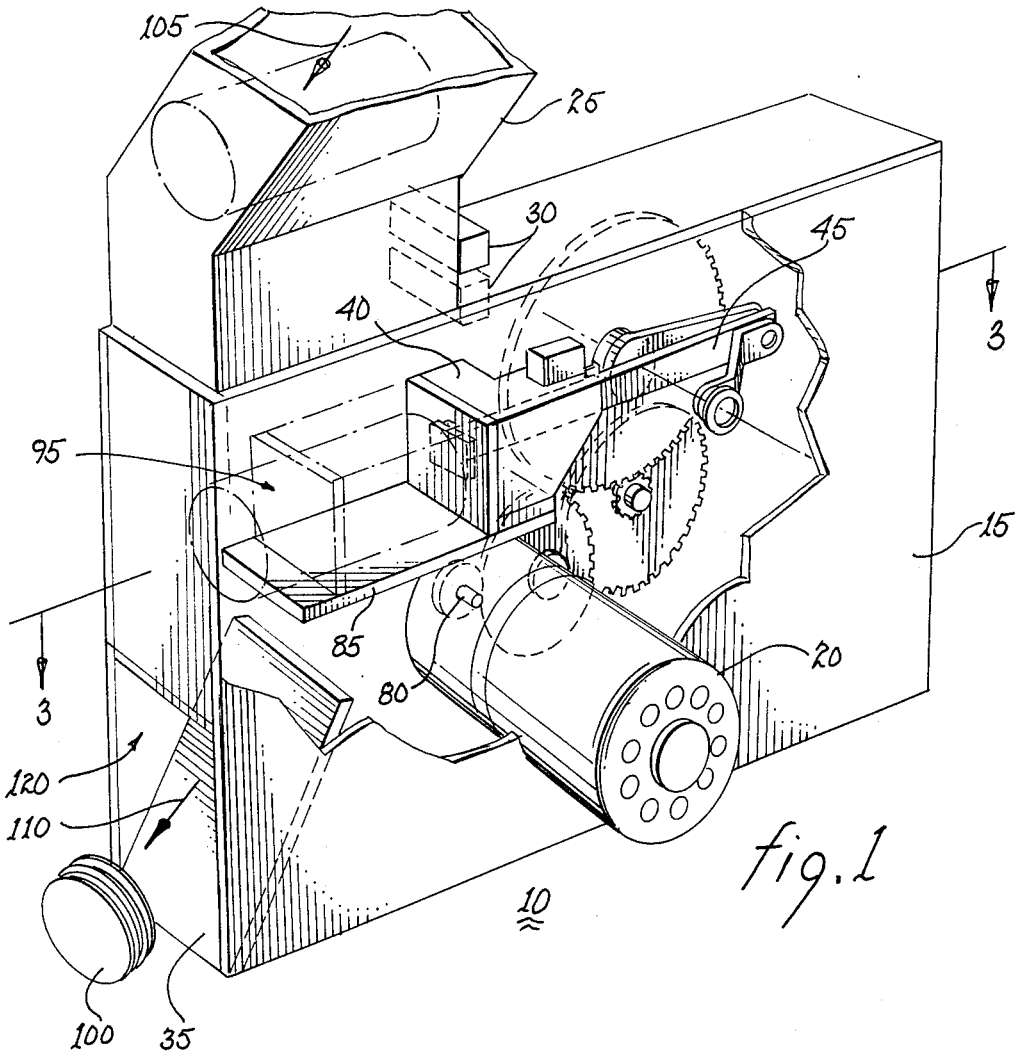
FIG. 1 is a partially cutaway perspective view of the improved can compacting apparatus.

Referring to FIG. 1 of the accompanying drawings which set forth the present invention in greater detail, and in which like numerals designate like elements, an improved can compacting apparatus 10 is generally illustrated comprising a box-like housing member 15, an electric motor 20, a detachable hopper 25, a safety switch 30, an exit baffle 35, and a compacting piston 40. The housing member 15 may be constructed of plastic material to minimize the weight of the apparatus 10 which will allow the compactor 10 to be supported by trash cans of synthetic construction such as those marketed by "Rubbermaid".

The route of a can through the compacting apparatus 10 is outlined in FIG. 1. Numeral 105 indicates the path of a can being gravitationally fed through the detachable hopper 25 into a position to be compacted 95, and numeral 110 indicates the path of a compacted can 100 exiting the compacting apparatus 10 through an exit orifice 120. In one embodiment of the present invention the can falls through the exit orifice 120 and contacts the exit baffle 35 which is angled to direct the crushed can onto the surface upon which the compactor 10 sits. In another embodiment (see FIG. 4), the exit baffle 35 is partially rotated around a horizontal axis, passing from one vertical edge of the baffle 35 to the other vertical edge, to allow the compacted can to drop directly into a receptacle (see FIG. 7).

Figure 2:
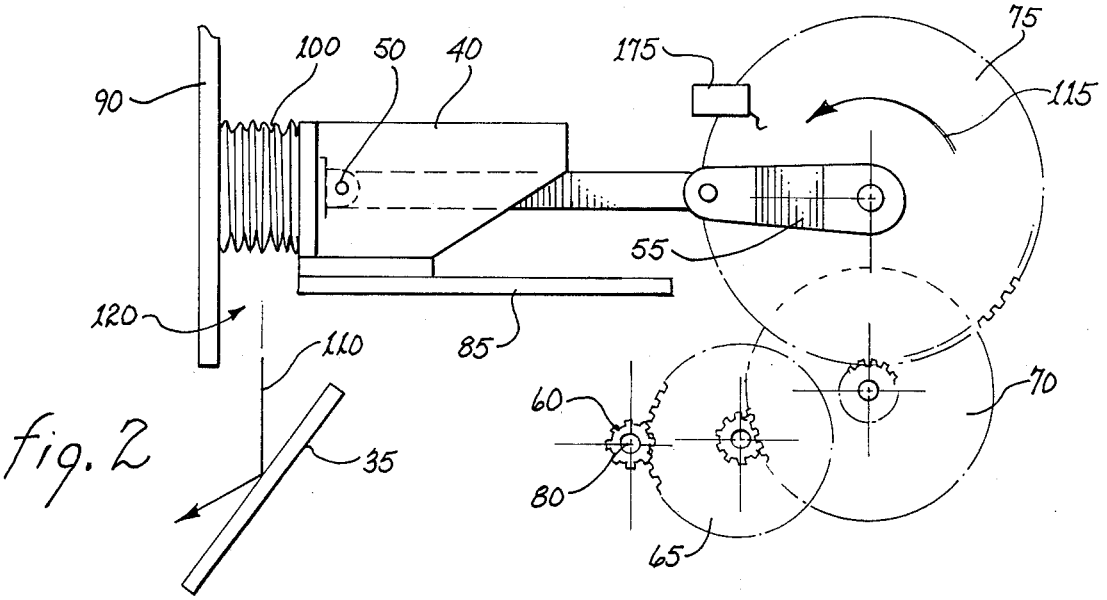
FIG. 2 is an inner side view illustrating the gear assemblies, the piston assembly, and the directing baffle of the instant invention.

As illustrated in FIG. 2, which generally shows a low friction drive train, a drive shaft 80 which is driven by the electric motor 20 includes a cogged gear portion 60. The cogged portion 60 of the drive shaft 80 cooperatively engages a primary reduction gear assembly 65 which cooperatively engages a secondary reduction gear assembly 70 which in turn cooperatively engages a final reduction gear assembly 75 that rotates in the direction of the arrow indicated by numeral 115. The final gear 75 is fixedly coupled to a piston drive member 55 which rotates directly therewith and which is hingedly coupled to one end of a piston rod member 45. The other end of the piston rod member 45 is coupled the piston 40 by a piston hinge 50.

The piston 40 is shown at the end of a compacting stroke which results in a longitudinally compacted can 100. A shut-off switch 175 ensures that piston 40 stops in a fully retracted position (see FIG. 4). The piston 40 slides along and is supported by a piston support member 85. The can compacting apparatus 10 includes a crushing wall member 90 which is integral with the housing member 15.

Figure 3:
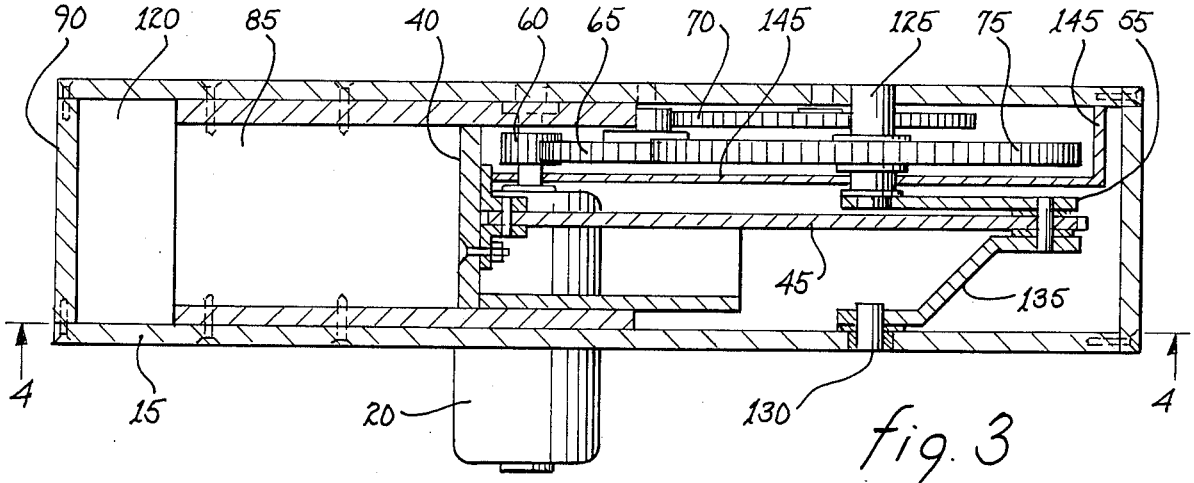
FIG. 3 is a cross sectional view taken along the line 3—3 of FIG. 1 in the direction of the arrows.

One embodiment of the present invention is shown in FIG. 3 which illustrates the inner alignment of the cogged portion 60 of the drive shaft 80, the reduction gear assemblies 65, 70, and 75, the drive member 55, the piston rod member 45, and the piston 40. An outer piston drive member 135 is hingedly coupled to the piston rod member 45 and is fixedly coupled, and therefore rotates correspondingly, with the piston drive member 55. The outer piston drive member 135 is coupled to the housing member 15 by an outer piston drive member bearing assembly 130 and thus provides axial support for the final reduction gear assembly 75. The final reduction gear assembly 80 is axially supported on an opposing side of the housing member 15 by a final reduction gear bearing assembly 125. A gear housing member 145 effectively encases the reduction gear assemblies 65, 70, and 75, to prevent lubricant from dripping therefrom.

Figure 4:
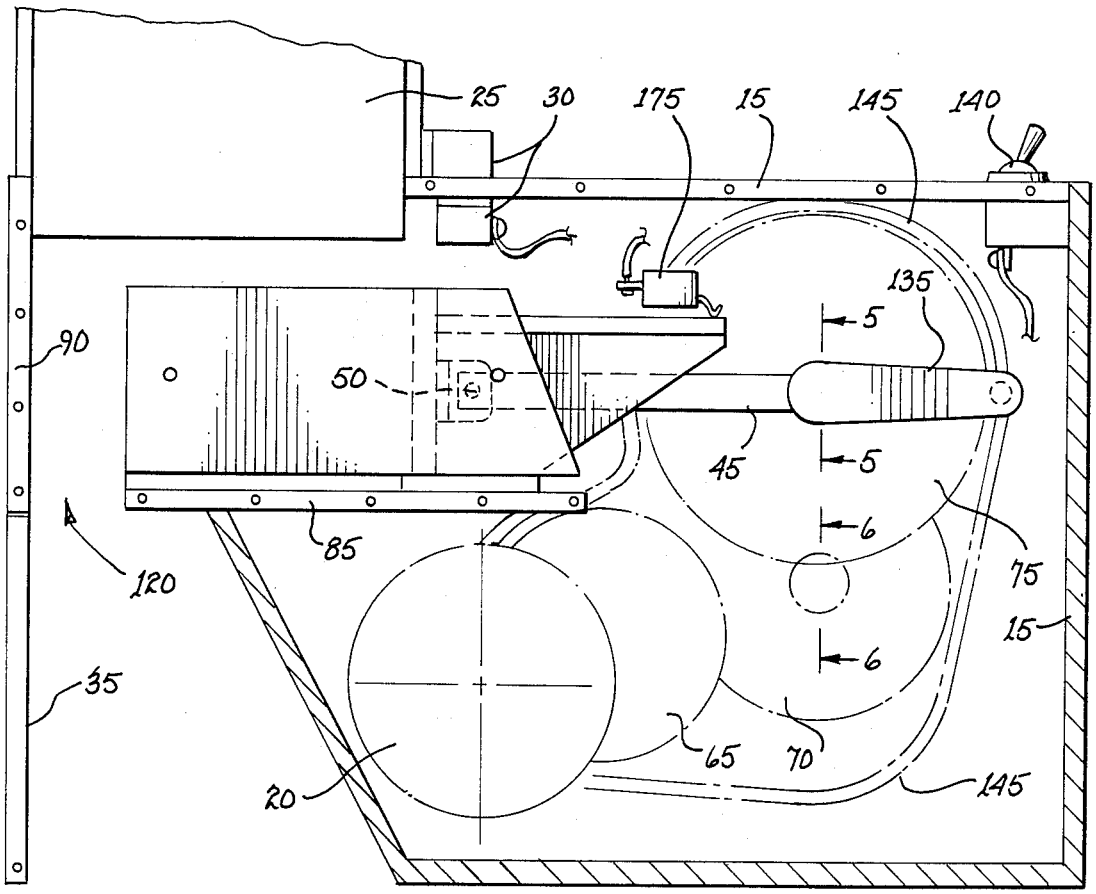
FIG. 4 is a cross sectional view taken along the line 4—4 of FIG. 3 in the direction of the arrows.

Referring now to FIG. 4, the outline of the gear housing member 145 is shown. FIG. 4 also illustrates one embodiment of the present invention which includes the housing member 15 having a partial floor portion; whereas in another embodiment, the housing member 15 does not include a floor portion so that the bottom is left open (see FIGS. 1 and 7). The exit baffle 35 is shown in the vertical position to allow compacted cans to drop directly into a receptacle (see FIG. 7).

One embodiment of the compactor 10 includes three electrical switches which are electrically connected in a conventional manner (wiring not shown): an on/off switch 140 is situated on the upper surface of the housing member 15; a two piece magnetictype safety switch 30 is positioned so that one of the two pieces is coupled to the detachable hopper 25 and the other piece is coupled to the housing member 15; and a shut-off switch 175 is coupled to an inner surface of the housing member 15.

Figure 5:
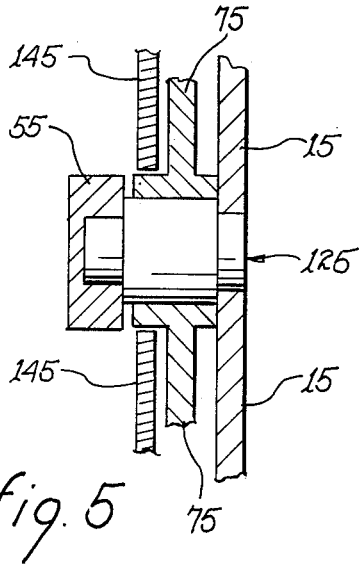
FIG. 5 is a cross sectional view taken along the line 5—5 of FIG. 4 in the direction of the arrows.

As seen in FIG. 5, the final reduction gear bearing assembly 125 is supported in the housing member 15 and the final reduction gear assembly 75 rotates within the chamber formed by the housing member 15 and the gear housing member 145. The piston drive member 55 is fixedly coupled to the final reduction gear assembly 75.

Figure 6:
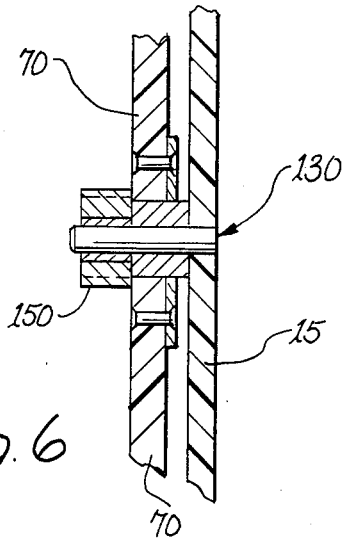
FIG. 6 is a cross sectional view taken along the line 6—6 of FIG. 4 in the direction of the arrows.

As illustrated best in FIG. 6, the outer piston drive member bearing assembly 130 is also supported in the housing member 15. A small cogged portion 150 of the secondary reduction gear assembly 70 cooperatively engages a large cogged portion of the final reduction gear assembly 75 (not shown; see FIG. 2).

Figure 7:
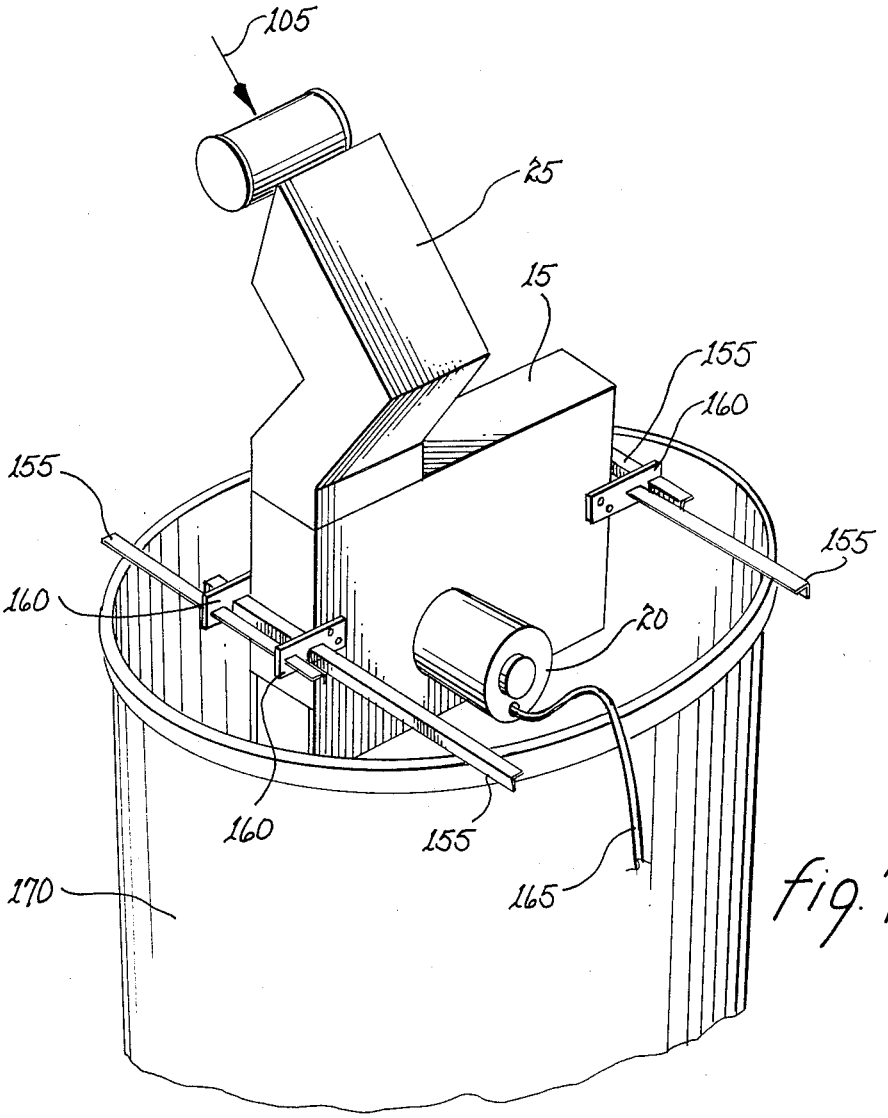

The embodiment of the can compactor 10 which is presented in FIG. 7 includes four adjustable support members 155. The support members 155 are slidably coupled to four (three shown) mounting brackets 160. The support members 155 may be longitudinally adjusted to support the compactor 10 on an upper surface of a variety of receptacles 170. Also, the electric motor 20 is connected by a power cord 165 to a power source, usually conventional household current.

SYSTEM OPERATION

The system operation of the present invention is relatively simple in nature. One or more cans, regular or tall, are placed into the hopper 25 and are gravitationally transported downward therethrough. The hopper 25 is shaped with a safety jog so that a person is not able to extend their hand completely through the hopper passage and into the compacting area; and because the hopper 25 must be properly in place to activate the safety switch 30, and thereby complete the electrical circuit, it is virtually impossible for a person to accidentally extend their hand into the compacting area while the machine is operating.

The cans are gravitationally transported into a position to be compacted (reference numeral 95) on the upper surface of the piston support member 85. The shut-off switch 175 operates to ensure that the piston 40 is always in the retracted position when the motor is turned off; and as a result of this positioning the first can to be crushed is always supported in position 95. The following cans are supported one on top of the other. However, during the compacting stroke, the next can to be crushed is supported by and rides on the upper surface of the piston 40.

The compacting apparatus 10 is activated when the on/off switch 140 is thrown. The motor 20 drives the reduction gear assemblies 65, 70, and 75, and consequently the piston drive member 55, causing the piston 40 to move in a horizontal compression stroke to compact a can. Once the first can has been compacted, it is small enough to drop through the exit orifice 120 and the piston moves back to the retracted position in a reciprocal stroke resulting from the further rotation of the piston drive member 55.

When the piston 40 is fully retracted, the next can falls into position to be crushed (reference numeral 95). The exiting can 100 follows the one of two mutually exclusive paths dictated by the positioning of the exit baffle 35. If the baffle 35 is aligned with crushing wall 90, the compacted can 100 drops directly into the receptacle 170. On the other hand, if the baffle 35 is aligned as shown in FIGS. 1 and 2, the exiting can 100 is horizontally deflected out of the housing member 15 and onto whatever surface the compactor 10 is supported by.

When it is desired to place the compactor 10 above a receptacle 170, the support members 155 are slidably adjusted so that they all rest on the rim of the receptacle 170. Due to the adjustable nature of the support members 155, the compactor 10 may be supported on receptacles 170 of a varied shapes and sizes.

After the last can desired to be compacted is processed, the on/off switch 140 is deactivated and the circuit will open when the shut-off switch 175 is triggered by the piston 40 returning to the retracted position.

While the invention has been particularly shown and described in reference to the preferred embodiments thereof, it will be understood by those skilled in the art that changes in form and details may be made without departing from the spirit and scope of the invention.

I claim:

1. A can compacting apparatus comprising:

housing member means for enclosing a plurality of moving parts;

hopper means operably coupled to said housing member means for receiving and automatically guiding at least one can to be compacted;

reduction gear means positioned in said housing member means for transferring mechanical power;

non-reversing electric motor means operably coupled to said reduction gear means for providing mechanical power;

means coupled to said housing member means for preventing longitudinal movement of one end of said at least one can during compacting;

a piston member means operated to reciprocate in an extended position and a retracted position and hingedly coupled to said reduction gear means for compacting said at least one can against said means for preventing longitudinal movement, said piston member means being driven by said reduction gear means;

a plurality of exit means for gravitationally transporting said at least one can out of said housing member means;

on/off switch means for turning on and off said motor means; and shut off switch means actuated by said reciprocating piston member means when said piston member is moving to the retracted position for deactivating said motor means when said on/off switch has been moved to an off position.

2. A can compacting apparatus comprising:

housing member means for enclosing a plurality of moving parts;

hopper means operably coupled to said housing member means for receiving and automatically guiding at least one can to be compacted;

reduction gear means positioned in said housing member means for transferring mechanical power;

means coupled to said housing member means for preventing longitudinal movement of one end of said at least one can during compacting;

reciprocating piston member means operably coupled to said reduction gear means for compacting said at least one can against said means for preventing longitudinal movement, said piston member means being driven by said reduction gear means;

a plurality of exit means for gravitationally transporting said at least one can out of said housing member means, each of said plurality of exit means being mutually exclusive; and A can compacting apparatus as recited in claim 1 wherein each of said plurality of exit means is mutually exclusive; and adjustable baffle means for directing said at least one can through one of said plurality of exit means.

3. A method of compacting at least one can comprising the steps of:

providing a can compacting apparatus comprising housing member means for enclosing a plurality of moving parts, hopper means coupled to said housing member means for receiving and automatically guiding at least one can to be compacted, reduction gear means positioned in said housing member means for transferring mechanical power, electric motor means operably coupled to said reduction gear means for providing mechanical power, means coupled to said housing member means for preventing longitudinal movement of one end of said at least one can during compacting, a piston member means operated to reciprocate in an extended position and a retracted position and operably coupled to and driven by said reduction gear means for compacting said at least one can against said means for preventing longitudinal movement, and a plurality of exit means for gravitationally transporting said at least one can out of said housing member means, each of said plurality of exit means being mutually exclusive;

providing adjustable baffle means for directing said at least one can through one of said plurality of exit means;

placing said at least one can in said hopper; and thereafter gravitationally transporting said at least one can through said compacting apparatus providing on/-off switch means for turning on and off said motor means; and thereafter providing a shut-off switch means actuated by said reciprocating piston member means when said piston member is moving to the retracted position for deactivating said motor means when said on/off switch has been moved to an off position.

* * * * *